US008020254B2

(12) United States Patent
Lin

(10) Patent No.: US 8,020,254 B2
(45) Date of Patent: Sep. 20, 2011

(54) HINGE ASSEMBLY

(75) Inventor: Yu-Feng Lin, Shulin (TW)

(73) Assignee: Shin Zu Shing Co., Ltd, Shulin (TW)

( * ) Notice: Subject to any disclaimer, the term of this patent is extended or adjusted under 35 U.S.C. 154(b) by 462 days.

(21) Appl. No.: 12/328,700

(22) Filed: Dec. 4, 2008

(65) Prior Publication Data

US 2010/0139043 A1 Jun. 10, 2010

(51) Int. Cl.
*E05D 11/10* (2006.01)

(52) U.S. Cl. ..... 16/334; 16/231; 16/319; 16/321; 16/327; 16/330; 16/362; 16/363; 16/364

(58) Field of Classification Search ..... 16/231, 16/232, 277, 284, 303, 319, 321, 322, 330, 16/327, 332, 334, 337, 362, 363, 364; 361/679.2, 361/679.12, 679.21, 679.39, 679.43, 679.58
See application file for complete search history.

(56) References Cited

U.S. PATENT DOCUMENTS

| | | | | |
|---|---|---|---|---|
| 2,703,431 | A * | 3/1955 | Tatom | 16/258 |
| 6,504,707 | B2 * | 1/2003 | Agata et al. | 361/679.05 |
| 6,601,713 | B2 * | 8/2003 | Kaminski | 211/26 |
| 7,024,727 | B1 * | 4/2006 | Huang et al. | 16/354 |
| 7,565,719 | B2 * | 7/2009 | Su | 16/337 |
| 7,669,286 | B2 * | 3/2010 | Lu et al. | 16/340 |
| 7,725,988 | B2 * | 6/2010 | Kim et al. | 16/361 |
| 2003/0109230 | A1 * | 6/2003 | Duarte et al. | 455/90 |
| 2005/0039301 | A1 * | 2/2005 | Lu et al. | 16/321 |
| 2006/0075603 | A1 * | 4/2006 | Hsieh | 16/330 |
| 2007/0050947 | A1 * | 3/2007 | Moore | 16/371 |
| 2007/0199179 | A1 * | 8/2007 | Wang | 16/340 |

* cited by examiner

*Primary Examiner* — Victor Batson
*Assistant Examiner* — Roberta S Delisle
(74) *Attorney, Agent, or Firm* — Apex Juris, pllc; Tracy M. Heims

(57) ABSTRACT

A hinge assembly has a pintle, a rotating bracket, a sliding bracket, a mounting bracket, a compression assembly and an elastic member. The rotating bracket is mounted rotatably around the shaft and has a latching portion. The sliding bracket is attached securely to the pintle and has a track. The mounting bracket and a latching arm. The latching arm selectively presses against the latching portion to hold the hinge closed. The compression assembly is mounted around and expands when the pintle is rotated to close. The elastic member is compressed by expansion of the compression assembly so automatically rotates the pintle to open. Therefore, with the hinge mounted in an electronic device, when the latching portion is slid out of the latching arm, the hinge is forced to open by the elastic member and compression assembly so a cover pops up and is opened easily.

10 Claims, 8 Drawing Sheets

HINGE ASSEMBLY

BACKGROUND OF THE INVENTION

1. Field of the Invention

The present invention relates to a hinge assembly, especially to a hinge assembly being mounted between a cover and a base of an electronic device to provide a latching and automatic opening mechanism.

2. Description of the Prior Arts

A hinge assembly is used to connect a cover to a base of an electronic device to allow the cover to pivot relative to the base.

A conventional electronic device further has a latch mounted near an edge of the cover, whereby the cover can be locked shut against the base by the latch. To use the electronic device, the latch is released and the cover may be pivoted away from the base.

However, especially with miniaturization and aesthetic appeal, such operation may be awkward, fiddly or require additional protuberances. Therefore, for convenience of opening the cover, a hinge assembly with a mechanism for facilitating opening of the cover is needed. Moreover, the delicate design of the current electronic device further intensifies demand for a hinge assembly with a mechanism adapted for quick and easy opening of the electronic device.

SUMMARY OF THE INVENTION

The main objective of the invention is to provide a hinge assembly having a latching and automatic opening mechanism.

A hinge assembly comprises a pintle, a rotating bracket, a sliding bracket, a mounting bracket, a compression assembly, an elastic member and a fastener.

The pintle has two ends and a shaft. The shaft is non-circular in cross section and is formed on one end of the pintle and has a distal end.

The rotating bracket is mounted rotatably around the shaft and has an inner surface, an outer surface, two ends and a latching portion. One of the ends is mounted rotatably around the shaft. The latching portion is formed on the other end of the rotating bracket.

The sliding bracket is attached securely to the other end of the pintle and has a track formed on the sliding bracket.

The mounting bracket is slidably mounted around the track and has two ends, at least one recess for accommodating the track and a latching arm. The latching arm is formed on one end of the mounting bracket, protrudes transversely from the mounting bracket and selectively presses against the latching portion.

The compression assembly is mounted around the shaft adjacent to the rotating bracket and has a moving member and a stationary member. The moving member is mounted rotatably around the shaft, is attached securely to the rotating bracket and has an inner surface, an outer surface and two moving positioning blocks. The inner surface faces the rotating bracket. The moving positioning blocks are formed diametrically opposite on the outer surface and each moving positioning block has a limiting surface and a slope. The limiting surface is perpendicular to the outer surface of the moving member. The slope extends from a corresponding limiting surface and converges to the outer surface of the moving member.

The stationary member is slidably mounted around the shaft adjacent to the moving member and has an inner surface, an outer surface and two stationary positioning blocks. The inner surface abuts the moving member. The stationary positioning blocks are formed diametrically opposite on the inner surface of the stationary member and each stationary positioning block has a limiting surface and a slope. The limiting surface is perpendicular to the inner surface of the stationary member. The slope extends from a corresponding limiting surface and converges to the inner surface of the stationary member.

The elastic member is mounted around the shaft and abuts the compression assembly. The fastener is mounted securely on the distal end of the shaft.

A hinge assembly in accordance with the present invention can be mounted between a cover and a base of an electronic device, wherein the rotating bracket is securely attached to the cover and the mounting bracket is securely attached to the base. The cover can be pivotally rotated to the base. When the latching portion abuts the latching arm, the cover can be secured to the base and the elastic member is compressed to obtain a potential energy.

To open the cover, the cover is slid allowing the latching portion to leave the latching arm. The elastic member extends and releases the potential energy and forces the stationary member to press the moving member and the slopes of the positioning blocks cause rotation of the pintle and the cover mounted on the rotating bracket. Consequently, the cover spontaneously pops up for easy opening. Therefore, the hinge assembly in accordance with the present invention provides a mechanism or latching and automatically opening the cover of an electronic device.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
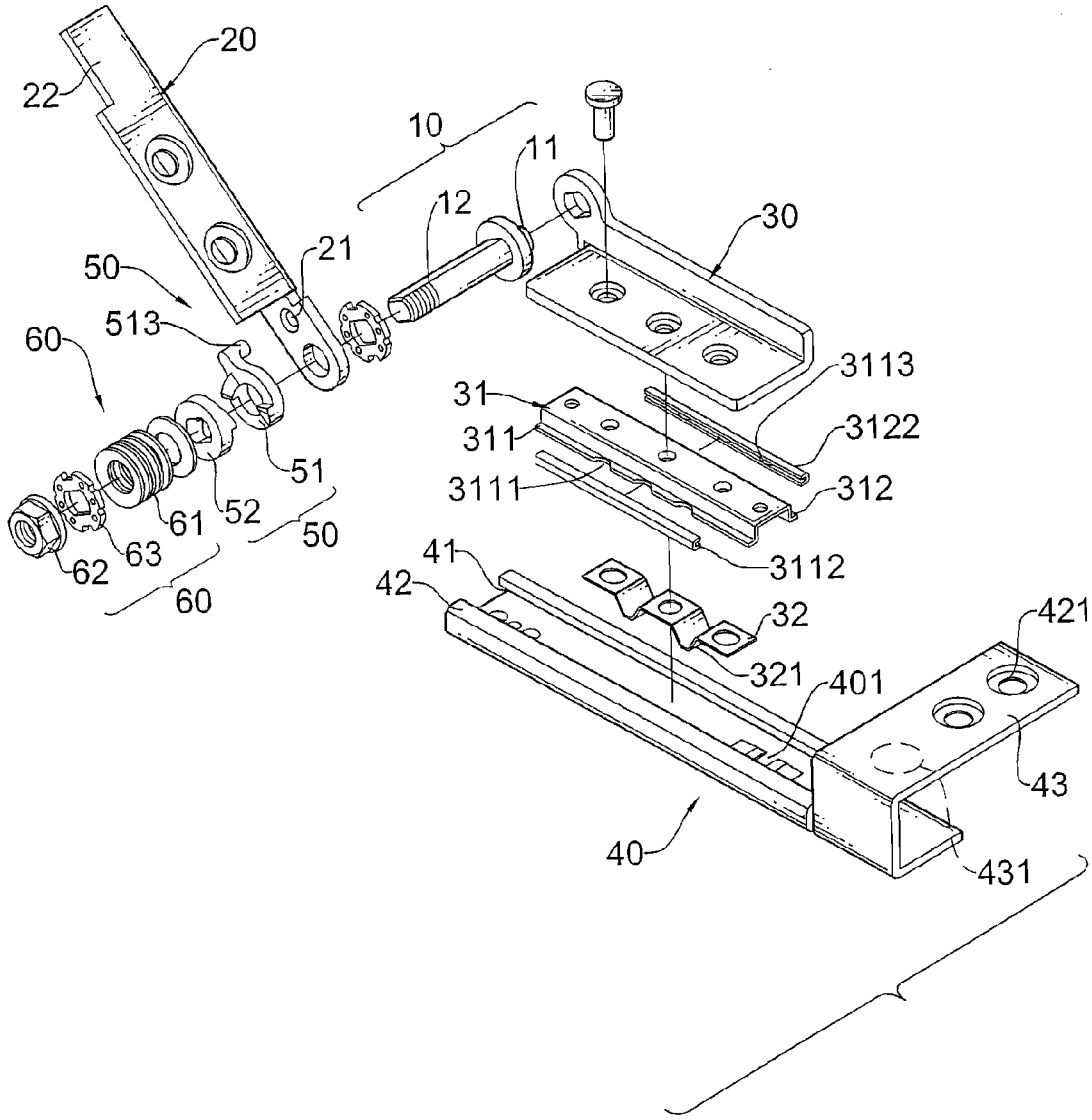
FIG. 1 is an exploded perspective view of a hinge assembly in accordance with the present invention.
Figure 2:
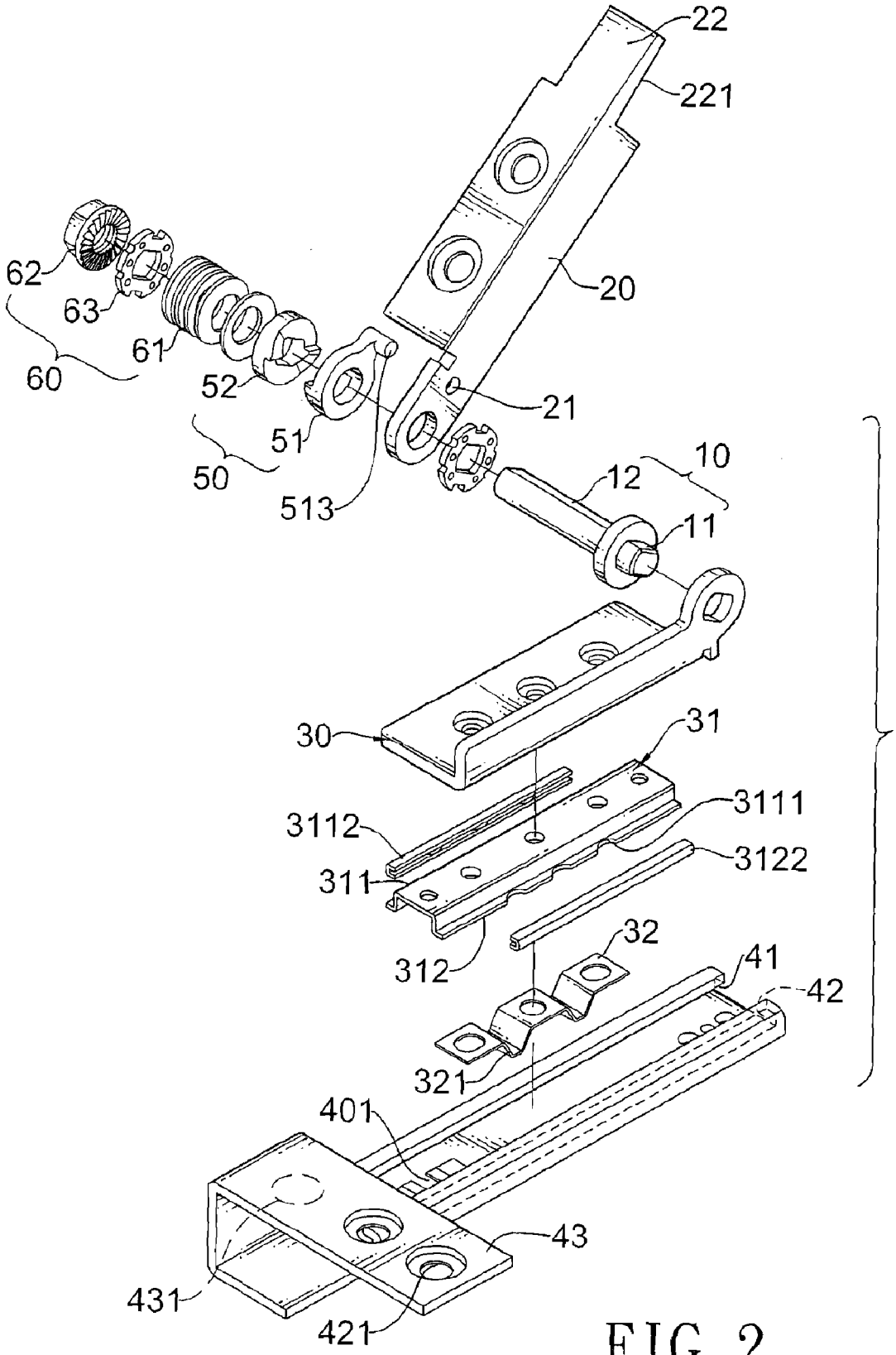
FIG. 2 is another exploded perspective view of the hinge assembly in FIG. 1.

With reference to FIGS. 1 and 2, a hinge assembly in accordance with the present invention comprises a pintle (10), a rotating bracket (20), a sliding bracket (30), a mounting bracket (40), a compression assembly (50) and a washer assembly (60).

The pintle (10) has two ends, a shaft (12) and an optional positioning rod (11). The shaft (12) is non-circular in cross section, is formed on one end of the pintle (10) and has a distal end and a threaded segment. The threaded segment is formed around the distal end of the shaft (1 2). The positioning rod (11) is formed on another end of the pintle (10).

The rotating bracket (20) is mounted rotatably around the shaft (12) and has an inner surface, an outer surface, a proximal end, a distal end, a latching portion (22), an optional hole and an optional aperture (21). The proximal end of the rotating bracket (20) is mounted rotatably around the shaft (12). The latching portion (22) is formed on the distal end of the rotating bracket (20) and has an optional inclined surface (221). The hole is formed through the proximal end of the rotating bracket (20) and is mounted rotatably around the shaft (12). The aperture (21) is formed through the inner surface and the outer surface of proximal end of the rotating bracket (20), maybe adjacent to the hole of the rotating bracket (20).

The sliding bracket (30) is attached securely to the pintle (10), may be attached securely to the positioning rod (11) of the pintle (10) and has a mounting protrusion, a track (31) and an optional positioning member (32).

The track (31) is attached to the mounting protrusion of the sliding bracket (30), may be formed on or mounted on the mounting protrusion and has two edges, an end, two wings (311, 312), two optional bar bearings (3112, 3122) and an optional groove. The wings (311, 312) are formed on and respectively protrude transversely from the edges of the track (31). Each wing (311, 312) has multiple notches (3111). Each bar bearing (3112, 3122) is mounted on a corresponding wing (311, 312) and has a side, a slit and multiple bulges (3113). The slits are respectively formed through the bar bearings (3112, 3122), correspond to and are mounted on a corresponding wing (311, 312). Each bulge (3113) is formed in the slit of each bar bearing (3112, 3122) and is mounted in a corresponding notch (3111) to prevent movement of the bar bearings (3112, 3122). The groove is formed between the wings (311, 312).

The positioning member (32) is mounted between the wings (311, 312) and in the groove of the track (31) and has at least one optional protrusion (321). The at least one protrusion (321) is formed on and protrudes from the positioning member (12) and protrudes from the track (31). Two protrusions (321) may be formed on the positioning member (32).

The mounting bracket (40) is slidably mounted around the track (31) of the sliding bracket (30) and has two ends, at least one recess (41, 42), a latching arm (43), at least one optional positioning portion (401) and at least one optional mounting hole (421).

The at least one recess (41) is formed in the mounting bracket (40) and accommodates the track (31), two recesses (41, 42) may be implemented and formed opposite to each other and respectively mounted around the wings (311, 312), and may correspond to and be mounted around the bar bearings (3112, 3122) to allow the track (31) to slide smoothly on the mounting bracket (40).

The positioning portion (401) is formed on the mounting bracket (40) between the recesses (41, 42) near one of the ends of the mounting bracket (40) and selectively engages the protrusion (321) of the positioning member (32), whereby the positioning portion (401) of the mounting bracket (40) selectively engages and is held by -the protrusion (321) of the positioning member (32) of the sliding bracket (30).

Figure 4:
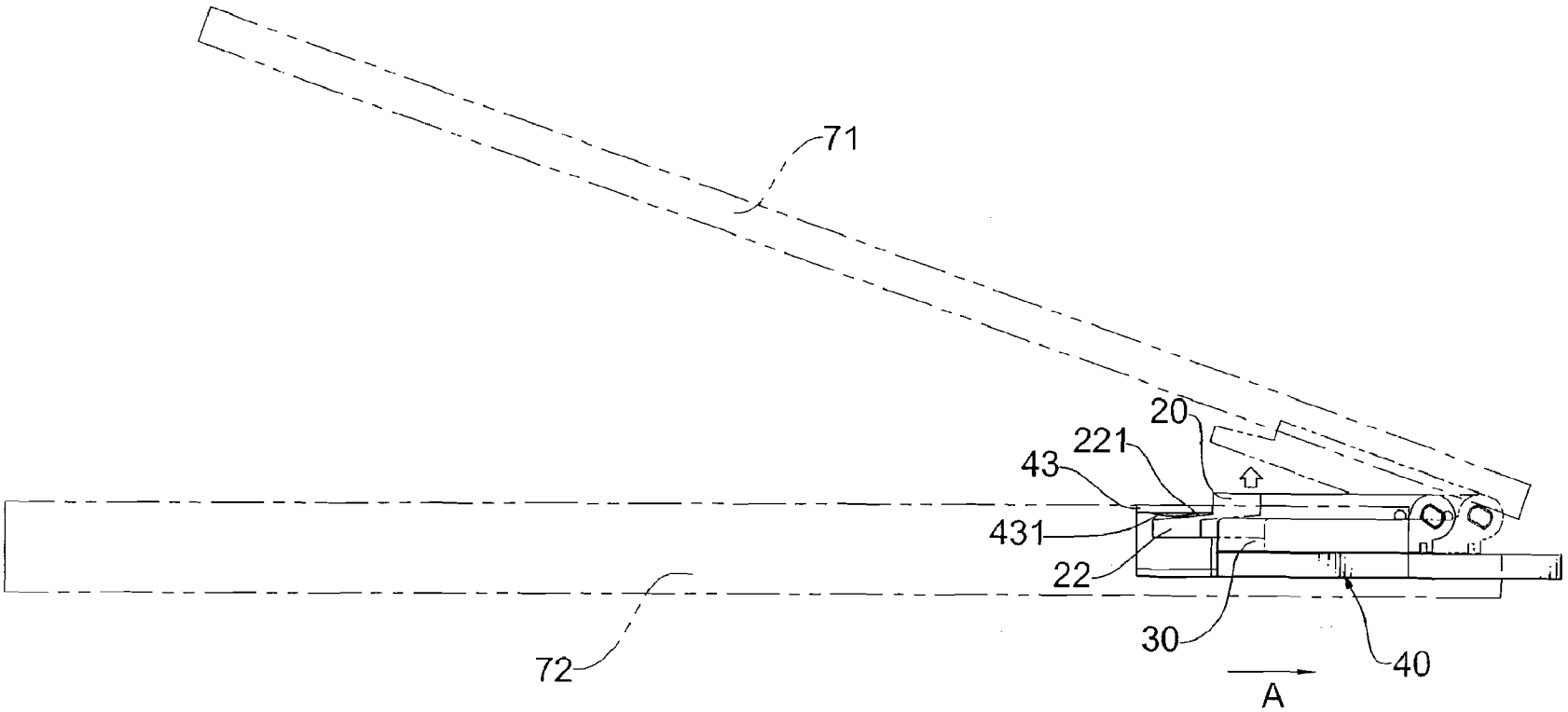
FIG. 4 is an operational side view of the hinge in FIG. 1 shown mounted in an electronic device and with a second operational position in phantom lines.

The latching arm (43) is formed on one end of the mounting bracket (40), protrudes transversely from the mounting bracket (40), selectively retains the latching portion (22) and has an optional protuberance (431). With further reference to FIG. 4, the protuberance (431) may be domical and corresponds to the inclined surface (221) of the latching portion (22) and selectively abuts the inclined surface (221) of the latching portion (22) with a minimum contact area. Therefore, the rotating bracket (20) can be slidably mounted on the mounting bracket (40) via the attachment between the track (31) of the sliding bracket (30) and the recesses (41, 42). The minimum contact area between the latching arm (43) and the inclined surface (221) of the latching portion (22) results in reduced friction between the latching arm (43) and the inclined surface (221).

The mounting hole (421) is formed on the latching arm (43) and allows a fastener mounting through to securely attach the mounting bracket (40) to a base of an electronic device.

Figure 3:
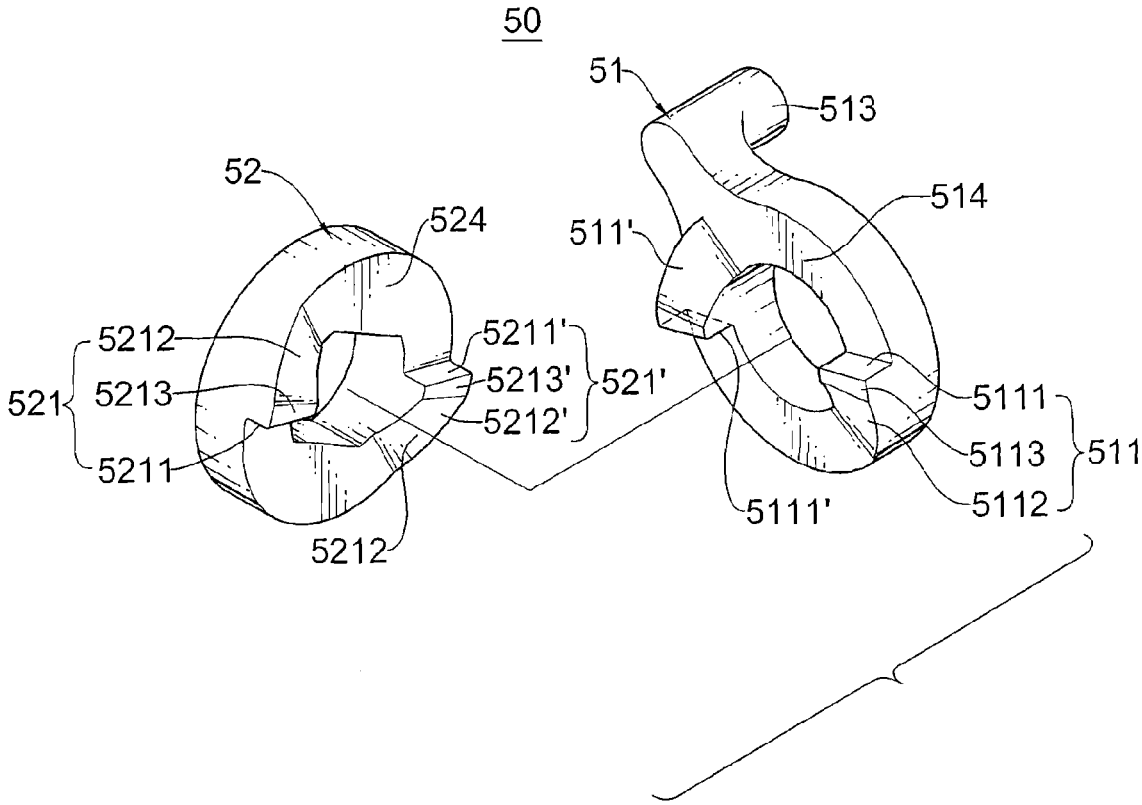
FIG. 3 is an enlarged, exploded perspective view of the compression assembly of the hinge assembly in FIG. 1.

With further reference to FIG. 3, the compression assembly (50) is mounted around the shaft (12) of the pintle (10) adjacent to the rotating bracket (20) and has a moving member (51) and a stationary member (52).

The moving member (51) is mounted rotatably around the shaft (12) of the pintle (10), is attached securely to the rotating bracket (20) and has an inner surface, an outer surface (514), an optional limiting projection (513) and two moving positioning blocks (511, 511'). The inner surface of the moving member (51) faces the rotating bracket (20). The limiting projection (513) is formed on the inner surface of the moving member (51) and is mounted through the aperture (21) of the rotating bracket (20). The moving positioning blocks (511, 511') are formed on the outer surface (514) of the moving member (51) diametrically opposite to each other. The moving positioning blocks (511, 511') have limiting surfaces (5111), optional flat surfaces (5113) and a slope (5112). The limiting surfaces (5111) are perpendicular to the outer surface (514) of the moving member (51). Each flat surface (5113) extends from a corresponding limiting surface (5111) and is parallel to the outer surface (514) of the moving member (51). Each slope (5112) extends from a corresponding limiting surface (5111) and converges to the outer surface (5 14) of the moving member (51).

The stationary member (52) is slidably mounted around the shaft (12) of the pintle (10) adjacent to the moving member (51) and has an inner surface (524), an outer surface and two stationary positioning blocks (521, 521'). The inner surface (524) of the stationary member (52) abuts the outer surface of the moving member (51). The stationary positioning blocks (521) are formed diametrically opposite on the inner surface (524) of the stationary member (52) and alternatively abuts the moving positioning blocks (511, 511'). The stationary positioning blocks (521) have limiting surfaces (5211, 5211'), optional flat surfaces (5213, 5213') and slopes (5212, 5212'). The limiting surfaces (5211, 5211') of the stationary positioning locks (521, 521') are perpendicular to the inner surface (524) of the stationary member (52). Each flat surface (5213) extends from the corresponding limiting surface (5211, 5211') and is parallel to the inner surface (524) of the stationary member (52). Each slope (5212, 5212') extends from a corresponding limiting surface (5211, 5211') and converges to the inner surface (524) of the stationary member (52).

The washer assembly (60) is mounted around the shaft (12) of the pintle (10) and has an elastic member (61), a fastener (62) and a washer (63). The elastic member (61) is mounted around the shaft (12) of the pintle (10) adjacent to the stationary member (52) of the compression assembly (50) to provide an elastic force. The fastener (62) is mounted securely on the distal end of the shaft (12) of the pintle (10) and may be a nut engaging the threaded segment (11) of the shaft (12) of the pintle (10). The washer (63) is mounted securely around the shaft (12) of the pintle (10) and may be mounted between the elastic member (61) and the fastener (62) to reduce abrasion between them.

A hinge assembly in accordance with the present invention is mounted between a cover (71) and a base (72) of an electronic device, wherein the rotating bracket (20) is securely attached to the cover (71) and the mounting bracket (40) is securely attached to the base (72). The cover (71) can be pivotally rotated to the base (72). When the inclined surface (221) of the latching portion (22) abuts against the latching arm (43), the cover (71) can be secured to the base (72). To open the cover (71), the cover (71) together with the track (31) of the sliding bracket (30) slides in a direction (A) for a determined distance to free the latching portion (22) from the latching arm (43), therefore, the cover (71) can be pivotally rotated relative to the base (72) without obstruction by the latching arm (43).

Figure 5:
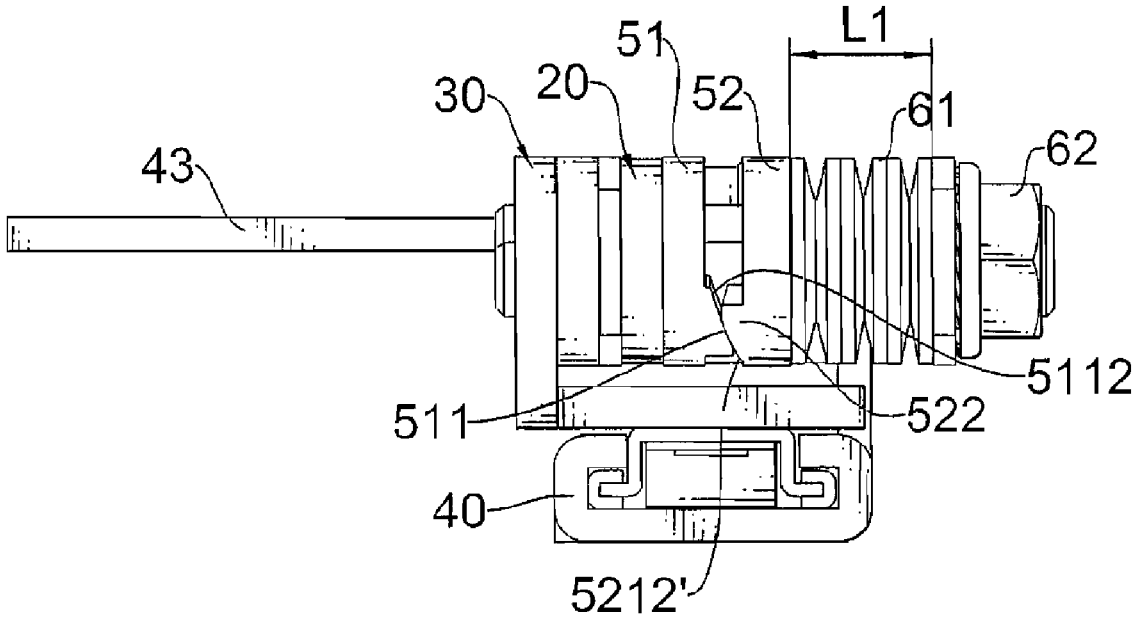
FIG. 5 is a front view of the hinge in FIG. 1.
Figure 6:
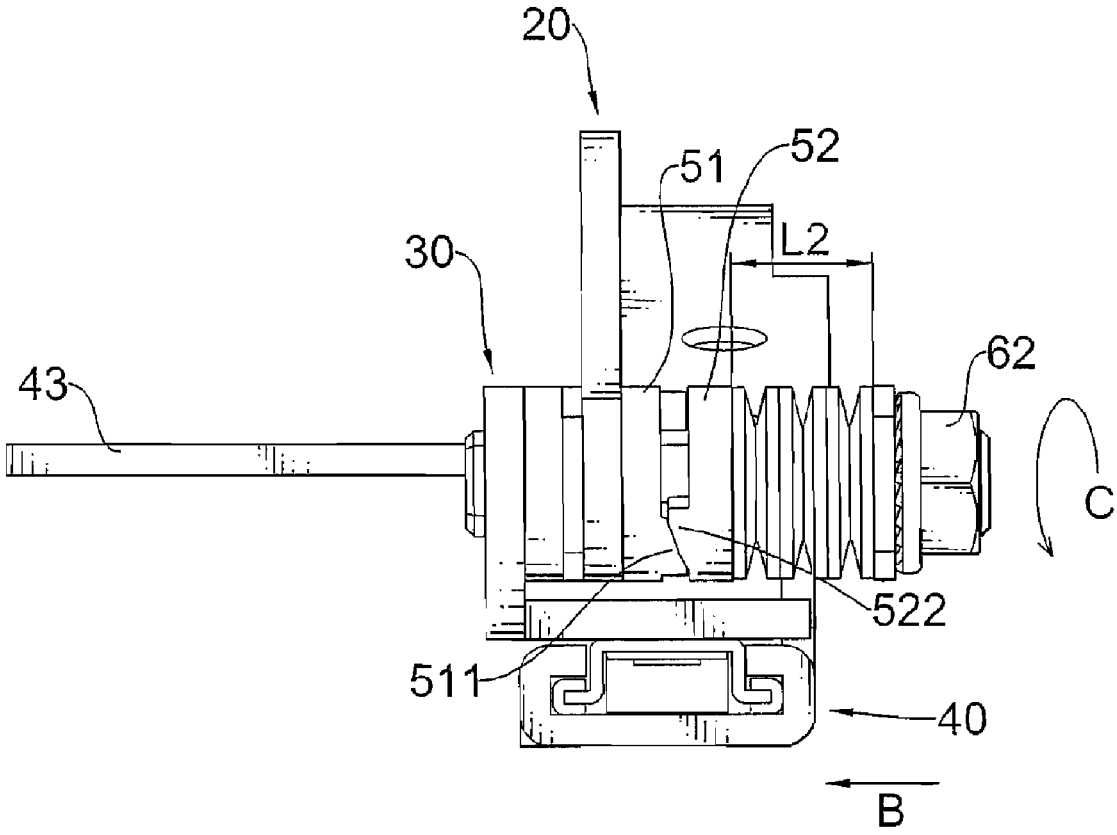
FIG. 6 is an operational front view of the hinge in FIG. 1.

With further reference to FIG. 5, when the cover (71) is secured by the base (72), the slopes (5112) of the moving positioning blocks (511, 511') abut the slope (5212, 5212') of the stationary positioning blocks (522). Meanwhile, the elastic member (61) is compressed to a length (L1) to obtain a potential energy. When the track (31) is slid on the mounting bracket (40) in the direction (A), the latching portion (22) is freed from the latching arm (43). With further reference to FIG. 6, the elastic member (61) extends to a second length (L2) and releases the potential energy to propels the stationary member (52) in a second direction (B), resulting in the slopes (5112) of the moving positioning blocks (511) to slide along the slopes (5212, 5212') of the stationary positioning blocks (522) causing the moving member (51) to rotate in a third direction (C) to drive the rotating bracket (20) and the cover (71) mounted on the rotating bracket (20) to rotate a certain angle. Consequently, the cover (71) spontaneously pops up to the certain angle and the cover (71) can be easily further opened.

Figure 7:
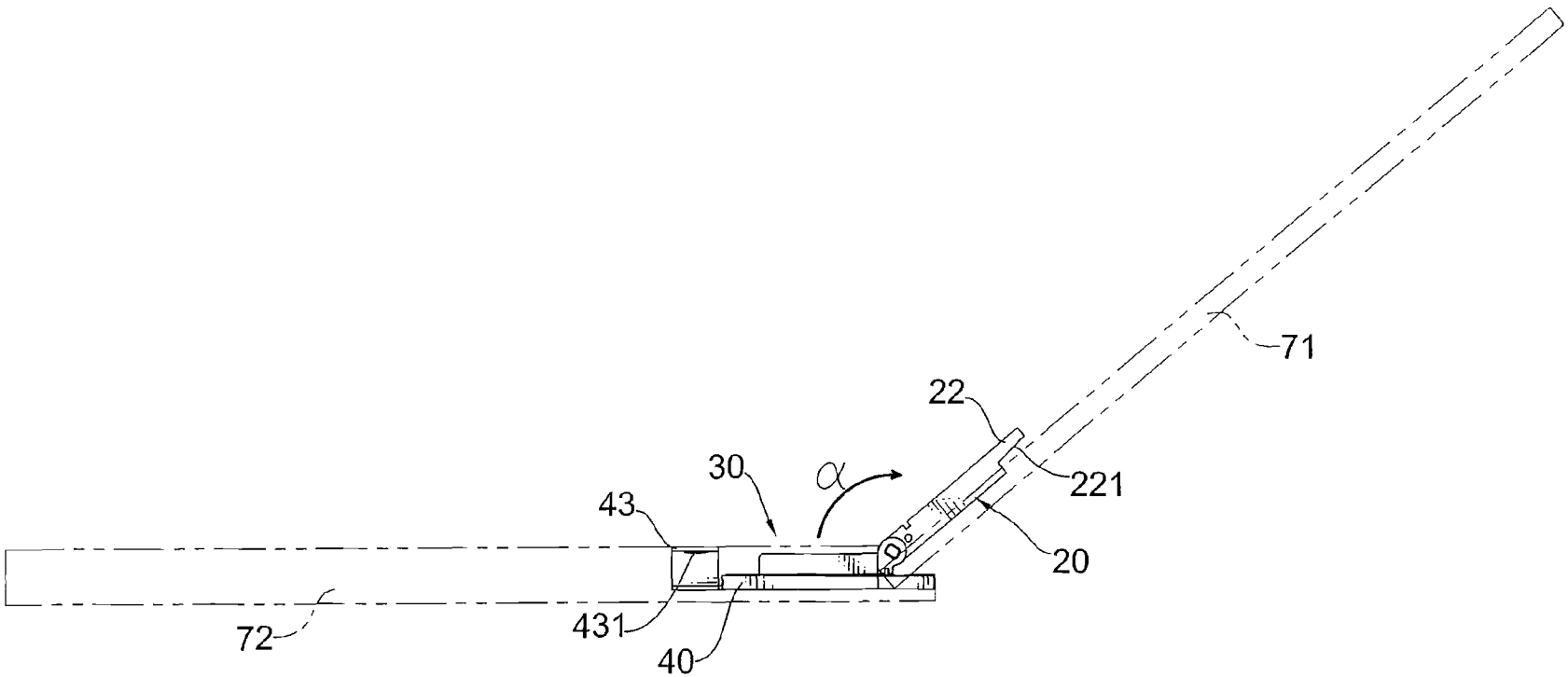
FIG. 7 is another operational side view in partial section of the hinge in FIG. 4.
Figure 8:
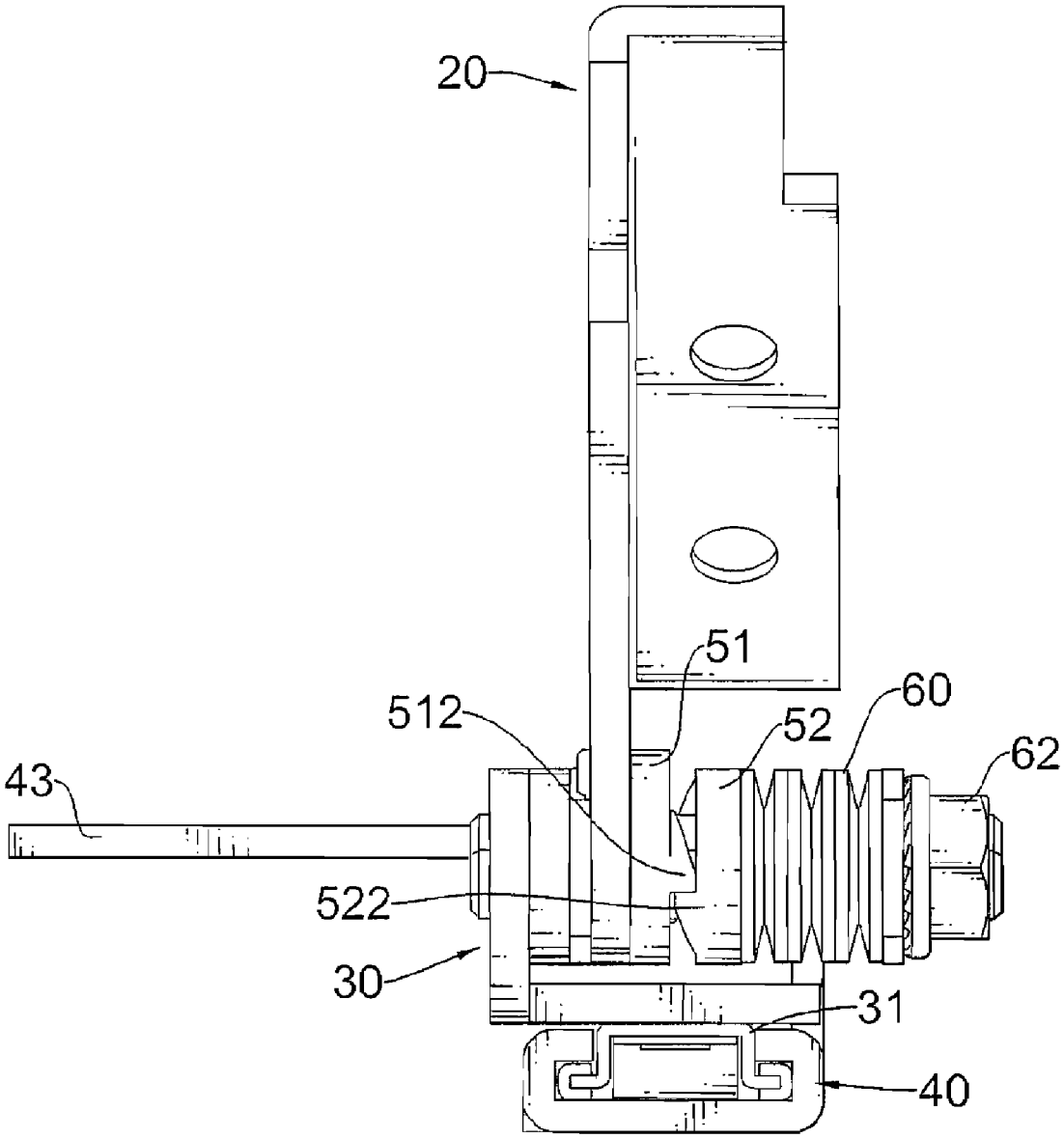
FIG. 8 is another operational front view of the hinge in FIG. 1.

With further reference to FIGS. 7 and 8, when the cover (71) is rotated to a predetermined angle ($\alpha$) relative to the base (70), the limiting surfaces (5111) of the moving positioning blocks (511) abut the limiting surfaces (5211) of the stationary positioning blocks (521) preventing the cover (71) from being rotated past the predetermined angle relative to the base (72) for stability and convenient viewing.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A hinge assembly comprising
- a pintle having
  - two ends; and
  - a shaft being non-circular in cross section, being formed on one end of the pintle and having a distal end;
- a rotating bracket being mounted rotatably around the shaft and having
  - an inner surface;
  - an outer surface;
  - a proximal end being mounted rotatably around the shaft;
  - a distal end; and
  - a latching portion being formed on the distal end of the rotating bracket;
- a sliding bracket being attached securely to the pintle and having
  - a mounting protrusion; and
  - a track being attached to the mounting protrusion;
- a mounting bracket being slidably mounted around the track and having
  - two ends;
  - at least one recess being formed in the mounting bracket and accommodating the track; and
  - a latching arm being formed on one end of the mounting bracket, protruding transversely from the mounting bracket and selectively retaining the latching portion;
- a compression assembly being mounted around the shaft adjacent to the rotating bracket and having
  - a moving member being mounted rotatably around the shaft, being attached securely to the rotating bracket and having
    - an inner surface facing the rotating bracket;
    - an outer surface;
    - two moving positioning blocks being formed opposite each other on the outer surface of the moving member and each moving positioning block having
      - a limiting surface being perpendicular to the outer surface of the moving member; and
      - a slope extending from the limiting surface and converging to the outer surface of the moving member; and
  - a stationary member being slidably mounted around the shaft adjacent to the moving member and having
    - an inner surface abutting the moving member;
    - an outer surface; and
    - two stationary positioning blocks being formed opposite on the inner surface of the stationary member and each stationary positioning block having
      - a limiting surface being perpendicular to the inner surface of the stationary member; and
      - a slope extending from the limiting surface and converging to the inner surface of the stationary member; and
- a washer assembly having
  - an elastic member being mounted around the shaft adjacent to the stationary member of the compression assembly; and
  - a fastener being mounted securely on the distal end of the shaft.

2. The hinge assembly of claim 1, wherein
- the track has
  - two edges;
  - an end; and
  - two wings being formed respectively on and protruding transversely from the edges of the track; and
- the mounting bracket has two recesses being respectively mounted around the two wings.

3. The hinge assembly of claim 2, wherein
- each wing of the track has multiple notches; and
- the track further has two bar bearings, and each bar bearing is mounted around one of the wings and in a corresponding recess of the mounting bracket and has
  - a side;
  - a slit being formed through the bar bearing and being mounted around a corresponding wing; and
  - multiple bulges, being formed in the slit of the bar bearing and mounted in the notches of the corresponding wing.

4. The hinge assembly of claim 2, wherein the track further has a groove being formed between the wings;
- the sliding bracket further has a positioning member being mounted between the wings and in the groove of the track; and
- the mounting bracket further has at least one positioning portion being formed in the mounting bracket between the recesses near one of the ends of the mounting bracket and selectively engaging and being held by the positioning member.

5. The hinge assembly of claim 3, wherein the track further has a groove being formed between the wings;

the sliding bracket further has a positioning member being mounted between the wings and in the groove of the track; and the mounting bracket further has at least one positioning portion being formed in the mounting bracket between the recesses near one of the ends of the mounting bracket and selectively engaging and being held by the positioning member.

6. The hinge assembly of claim 1, wherein the latching portion of the rotating bracket further has an inclined surface; and the latching arm further has a protuberance corresponding to the inclined surface of the latching portion and selectively abutting the inclined surface of the latching portion.

7. The hinge assembly of claim 2, wherein the latching portion of the rotating bracket further has an inclined surface; and the latching arm further has a protuberance corresponding to the inclined surface of the latching portion and selectively abutting the inclined surface of the latching portion.

8. The hinge assembly of claim 3, wherein the latching portion of the rotating bracket further has an inclined surface; and the latching arm further has a protuberance corresponding to the inclined surface of the latching portion and selectively abutting the inclined surface of the latching portion.

9. The hinge assembly of claim 4, wherein the latching portion of the rotating bracket further has an inclined surface; and the latching arm further has a protuberance corresponding to the inclined surface of the latching portion and selectively abutting the inclined surface of the latching portion.

10. The hinge assembly of claim 5, wherein the latching portion of the rotating bracket further has an inclined surface; and the latching arm further has a protuberance corresponding to the inclined surface of the latching portion and selectively abutting the inclined surface of the latching portion.

* * * * *